US006810775B2

(12) United States Patent
Yang

(10) Patent No.: US 6,810,775 B2
(45) Date of Patent: Nov. 2, 2004

(54) PIPE PLIERS WITH AUXILIARY PRESSURIZING MECHANISM

(76) Inventor: Tai-Her Yang, No. 59, Chung Hsiao 8 St., Si-Hu Town, Dzan-Hwa (TW)

( * ) Notice: Subject to any disclaimer, the term of this patent is extended or adjusted under 35 U.S.C. 154(b) by 98 days.

(21) Appl. No.: 10/101,596

(22) Filed: Mar. 21, 2002

(65) Prior Publication Data

US 2003/0177875 A1 Sep. 25, 2003

(51) Int. Cl.[7] ..... B25B 13/16
(52) U.S. Cl. ..... 81/167; 81/165
(58) Field of Search ..... 81/100, 165, 167, 81/169

(56) References Cited

U.S. PATENT DOCUMENTS 1,075,878 A * 10/1913 Urquhart ..... 81/165
2,102,287 A * 12/1937 Smethers ..... 81/167
2,769,359 A * 11/1956 Healy ..... 81/165
3,578,307 A * 5/1971 Lock ..... 81/167
4,151,764 A * 5/1979 Bunn ..... 81/167

* cited by examiner

*Primary Examiner*—James G. Smith
(74) *Attorney, Agent, or Firm*—Rabin & Berdo, P.C.

(57) ABSTRACT

An improved structure of a pair of pipe pliers with an auxiliary pressurizing mechanism, to drive both of a movable jaw at the inner side of a curved, movable block provided with a toothed section and a fixed jaw at the output of a handle to execute firmly holding a work object by pressurizing in opposite direction characterized by that the auxiliary pressurizing mechanism includes an additional auxiliary handle, or alternatively, a lateral adjusting screw structure to achieve the function by pressurizing to hold the work object.

5 Claims, 6 Drawing Sheets

PIPE PLIERS WITH AUXILIARY PRESSURIZING MECHANISM

BACKGROUND OF THE INVENTION (a) Field of the Invention

The present invention is related to a pair of pipe pliers with an auxiliary pressurizing mechanism, and more particularly, to a mechanism that allows relative pressurizing between a fixed jaw and a curved, movable jaw.

(b) Description of the Prior Art

A conventional pair of pipe pliers operates by inserting a pipe work piece into a slightly inclined opening formed between a curved, movable, toothed jaw and a fixed, toothed jaw at a force output end of a handle. The work piece may then be turned as desired. However, in practice, it usually requires several adjustments since it is difficult for the pliers to match the size of the work piece. Furthermore, it is also difficult for the pliers to be removed from the work piece after turnings since the work piece is held by the pliers by means of engagement at a certain inclination.

SUMMARY OF THE INVENTION

The primary purpose of the present invention is to present a pair of pipe pliers with an auxiliary pressuring mechanism to apply a relative pressuring to secure the work piece between the curved movable jaw and the fixed jaw at the force output end of the handle. The auxiliary pressurizing mechanism includes an additional auxiliary handle, or an additional laterally spiral force structure to achieve the purpose of pressurizing to secure the work piece.

DETAILED DESCRIPTION OF THE PREFERRED EMBODIMENTS

Figure 10:
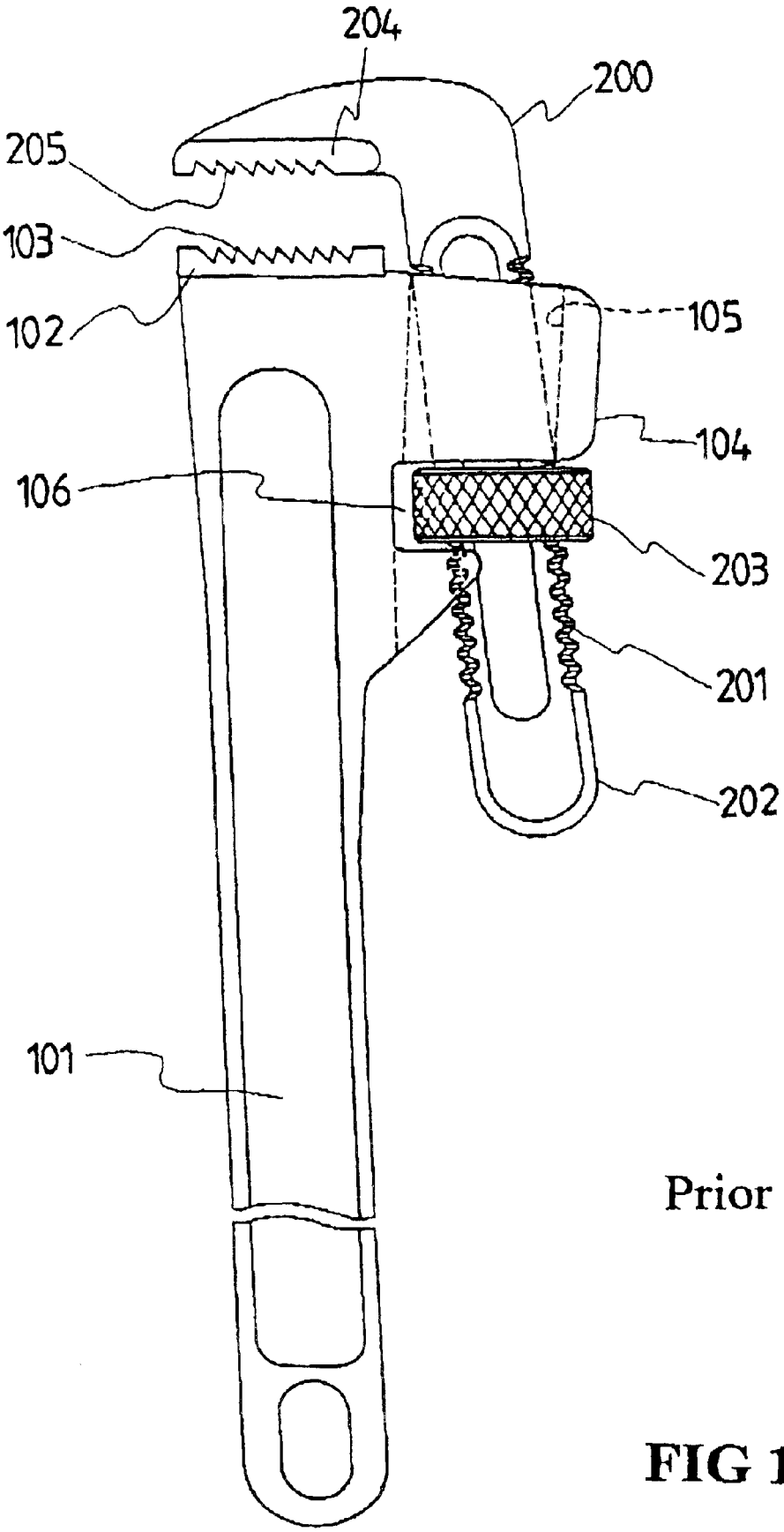
Prior Art FIG 10
FIG. 10 is a schematic view of a prior art pair of pipe pliers.

Referring to FIG. 10, the prior art pair of pipe pliers is essentially comprised of a handle 101 made of selected materials. One end of the handle 101 is for applying a force and the other end is the force output end. A fixed jaw 102 is extended from the force output end. The fixed jaw 102 is provided with a toothed structure 103. A channel holder 104 provided with an adjustable channel 105 is extended sideways from the output end of the handle 101. The adjustable channel 105 defines an approximately square hole having an axis in parallel or approximately in parallel with the handle 101. An adjusting lever 202 is provided with a toothed section 201, and a movable curved block 200. The adjusting lever has a geometric shape that matches a shape of the adjustable channel 105. The adjusting lever is insertable into the adjustable channel 105, and is engaged therein in a loose fashion. An adjusting nut 203 is provided on the adjusting lever 202 to manipulate the adjusting lever 202 by engaging the toothed section 201, to execute relatively axial displacement for adjustment. The adjusting nut 203 is disposed in a limiting gap 106 provided in the channel holder 104. The toothed section 201 of the movable block 200 is pushed as the adjusting nut is turned, so that the fixed jaw 204 on the inner side of the curved, movable block 200, and the movable jaw 102 disposed at the output end of the handle 101 are relatively displaced for adjustment. The primary function of the known device is to form an opening that has a larger outer portion and a smaller inner portion defined by the fixed jaw 102 and the movable jaw 204, which are loosely engaged to each other. The opening then receives and tightly presses against a tube or a bar piece by the toothed jaws 102 and 204, to drive the work piece. However, the prior art has the following flaws:

1) Usually it takes several adjustments before the opening properly holds the work piece, making manipulation less convenient, and even more difficult for non-professional users; and
2) Once the adjusting nut is turned and the workpiece is held, the nut is prevented from being continuously turned, and a hammer may be required to knock off the work piece before turning the adjusting nut.

Figure 1:
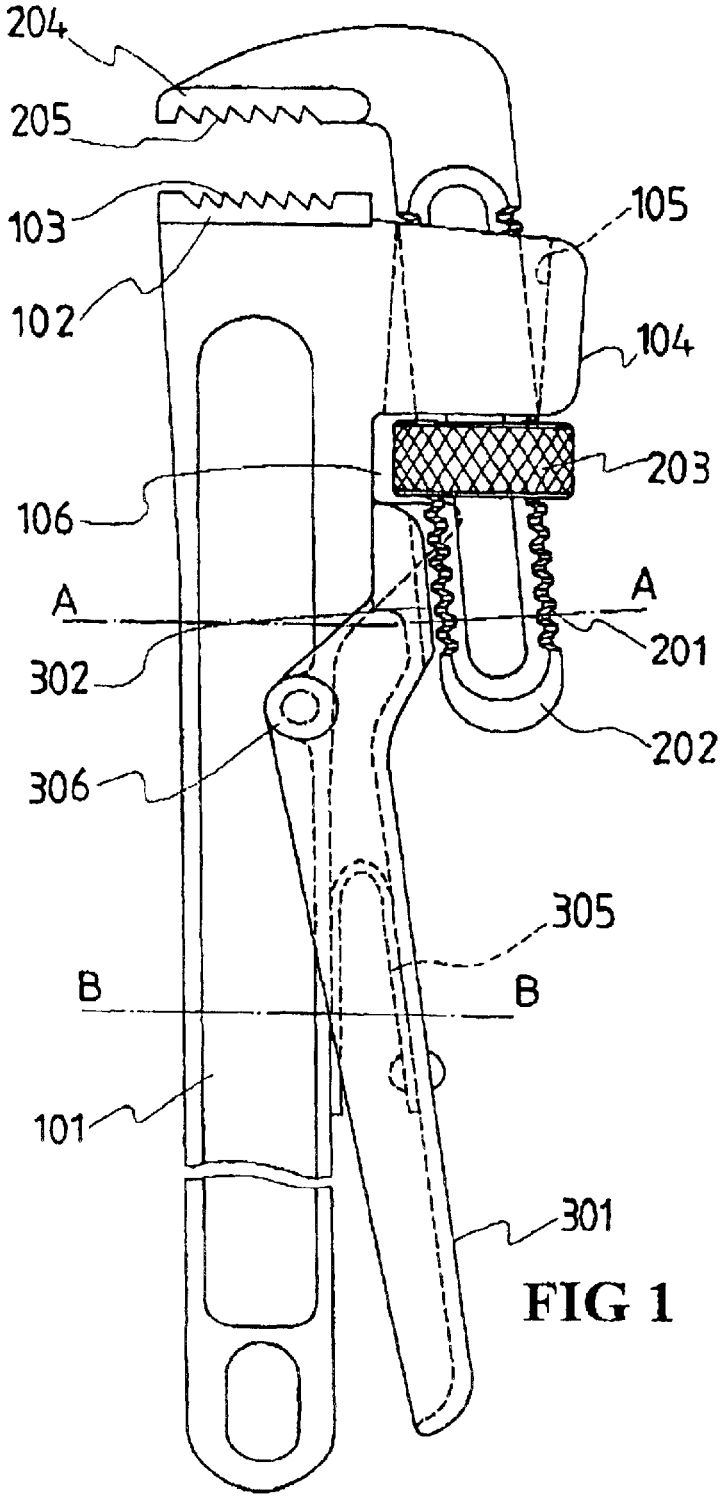
FIG. 1 is a view of a first preferred embodiment of the present invention.
Figure 2:
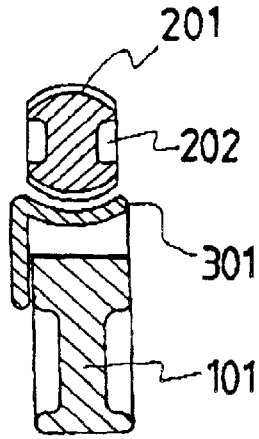
FIG. 2 is a sectional view of A-A' taken from FIG. 1.
Figure 3:
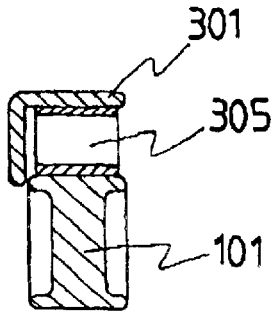
FIG. 3 is a sectional view of B-B' taken from FIG. 1.

The present invention relates to a pair of pliers that is provided with an auxiliary pressurizing mechanism to eliminate those defects found with the prior art, by providing the pair of pliers with an active holding feature by pressurizing. The invention includes:

1. A pressurizing mechanism made out of an active pressurizing handle in any of the following ways:
   (1) The active pressurizing handle may be an additional crank shaped handle structure with the crank shaped handle 301 having a curvature of a pre-selected angle. Handle 301 may be provided with a slip joint 303 and a return spring 305. The longer end of the handle 301 allows an operator to actively press against it. The handle 301 is able to return to its original position by means of the return spring 305. The output end of the handle can be configured in different ways, as follows:

Refer to FIG. 1 for a first preferred embodiment of the present invention. FIG. 2 is a sectional view of A-A' taken from FIG. 1, and FIG. 3 is a sectional view of B-B' taken from FIG. 1.

1. The output end of the crank shaped handle 301 is shaped to form a curved press hammerhead structure 302, so that the handle 301 is essentially z-shaped. A joint 306 is provided at a middle section of the hammerhead structure 302 for coupling the hammerhead structure 302 to a middle section of the handle 101. The handle 301, when pressed, will force the lower side of the adjusting lever 202 outward, and the curved moveable block 200 provided with a toothed section 201 closer to the active pressurizing handle 101. Thus when the crank shaped handle 301 is pressed, the movable jaw 204 at the inner side of the curved, movable block 200 is moved to execute a relative pressurizing with the fixed jaw 102 at the output end of the active pressurizing handle 101, to tightly hold a work piece.

Figure 4:
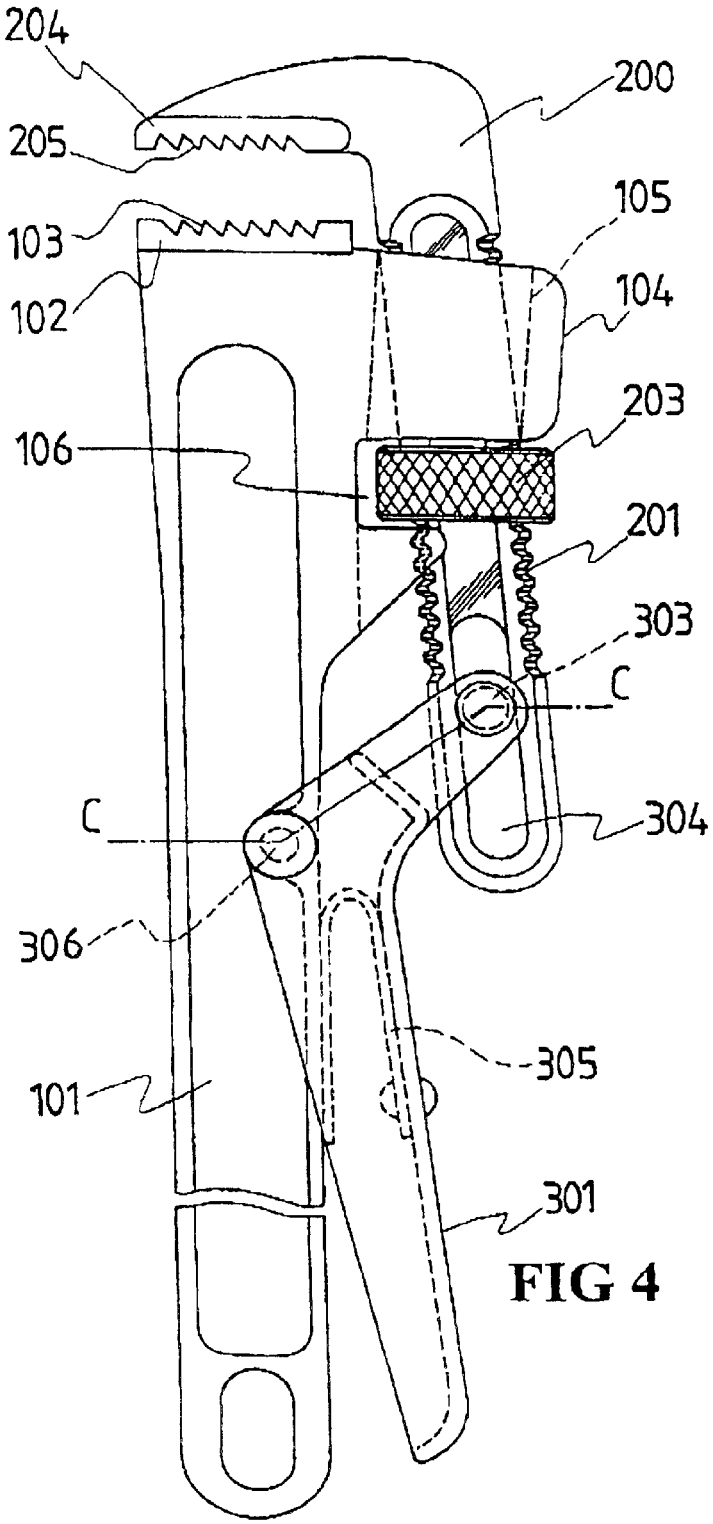
FIG. 4 is a view showing a second preferred embodiment of the present invention.
Figure 5:
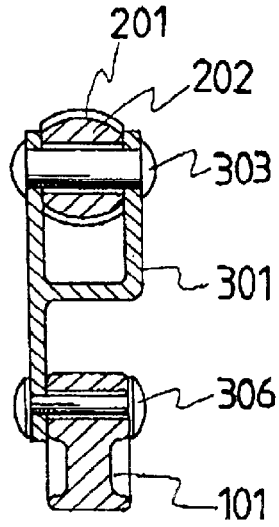
FIG. 5 is a sectional view of C-C' taken from FIG. 4.

FIG. 4 shows a second preferred embodiment of the present invention and FIG. 5 shows a sectional view of C-C' taken from FIG. 4. A slip joint 303 is provided at the terminal of the output end of the crank shaped handle 301, and is slidably coupled to a longitudinal channel 304 formed in the end of the adjusting lever 202. Thus, both the longitudinal channel 304 and the slip joint 303 are effectively matched during an adjusting course of the curved, movable block 200. A joint 306 is provided at a middle section of the crank shaped handle 301 to couple handle 301 to a middle section of the handle 101. Thus, when the crank shaped handle 301 is squeezed, the movable jaw 204 is pressed toward the fixed jaw 102 of the handle 101 to hold the work object.

Figure 6:
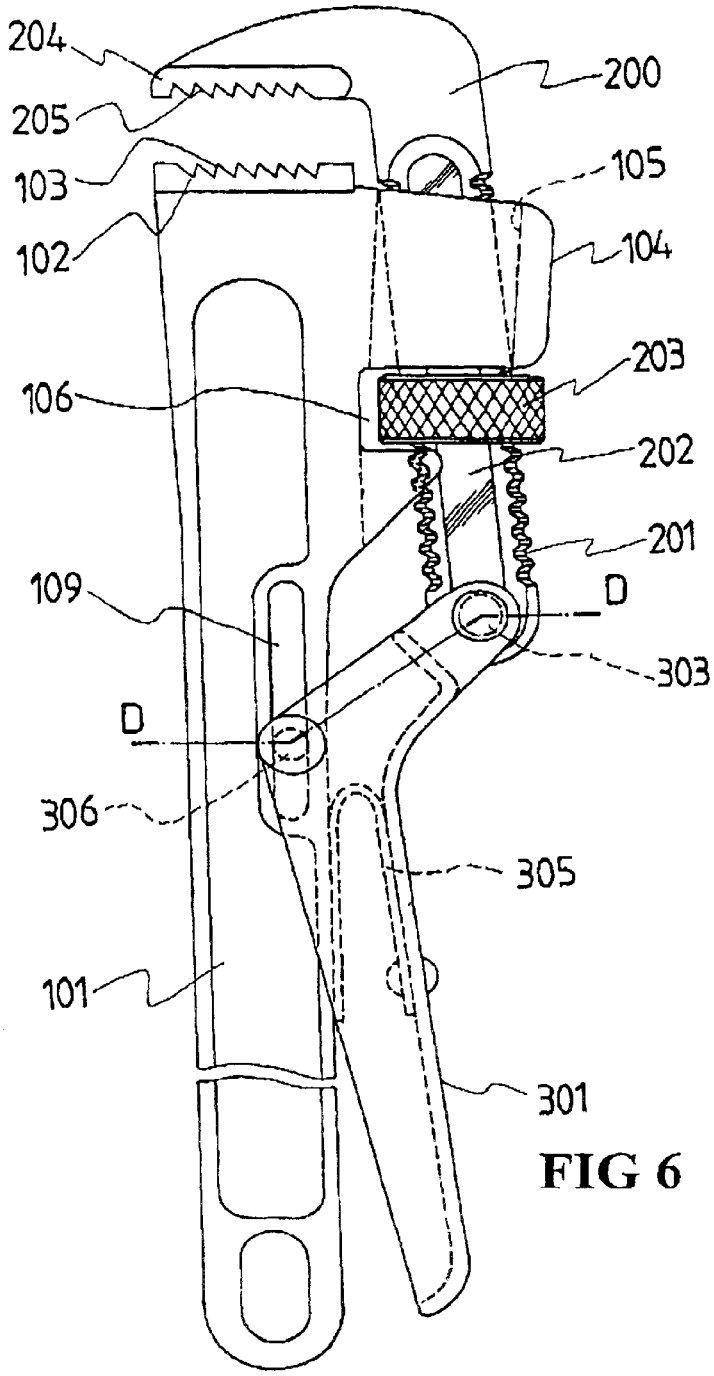
FIG. 6 is a view showing a third preferred embodiment of the present invention.
Figure 7:
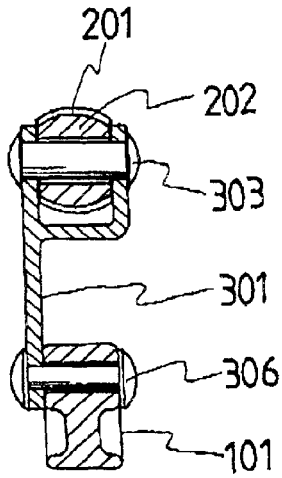
FIG. 7 is a sectional view of D-D' taken from FIG. 6.

FIGS. 6 and 7 respectively show a third preferred embodiment of the present invention. A sectional view of D-D' taken from FIG. 6 illustrates the slip joint 303 is provided at the output end of the crank shaped handle 301 to engage with the end of the adjusting lever 202. A joint 306 of the crank shaped handle 301 is slidably coupled to a longitudinal channel 109 provided in the handle 101. The joint 306 also slides while the adjusting lever 202 is relatively adjusted in position with the handle 101, so that when the crank shaped handle 301 is pressed, the movable jaw 204 is pressed toward the fixed jaw 102 of the handle 101, to hold the work object.

Figure 8:
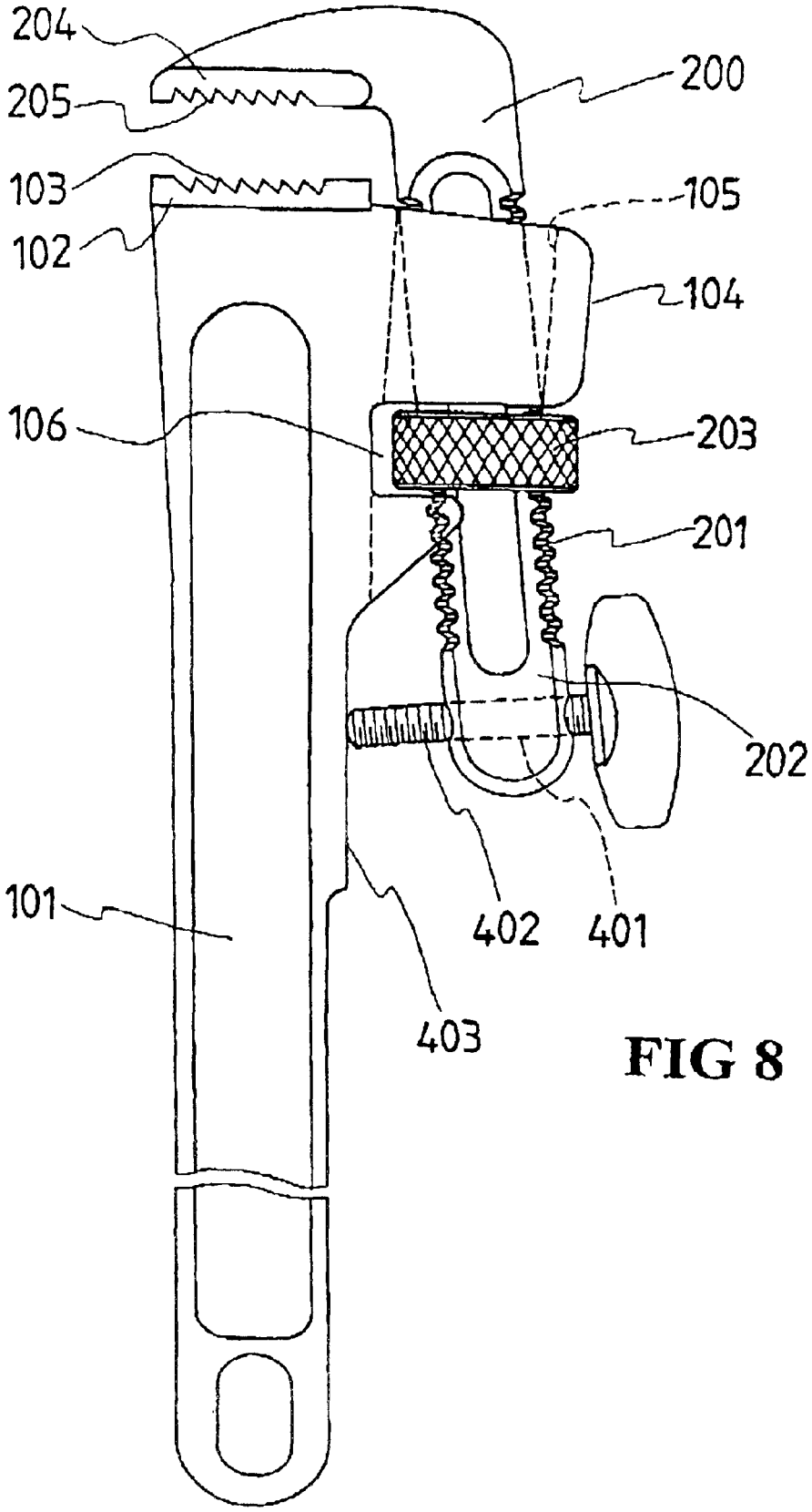
FIG. 8 is a fourth preferred embodiment of the present invention.

FIG. 8 shows a fourth preferred embodiment of the present invention. A sideway screw hole 401 and a threaded rod 402 that can be turned are provided in the adjusting lever 202, so that the rod 402 engages with the side of the handle 101. A surface 403 subject to pressure is provided on the handle 101 facing the adjusting lever 202 to form a pressurizing structure together with the threaded rod 402 that can be turned in the sideway screw hole 401. By operating the threaded rod 402 to press against the surface 403 on the handle 101, the movable jaw 204 is pressed toward the fixed jaw 102 of the handle 101 to hold the work object.

Figure 9:
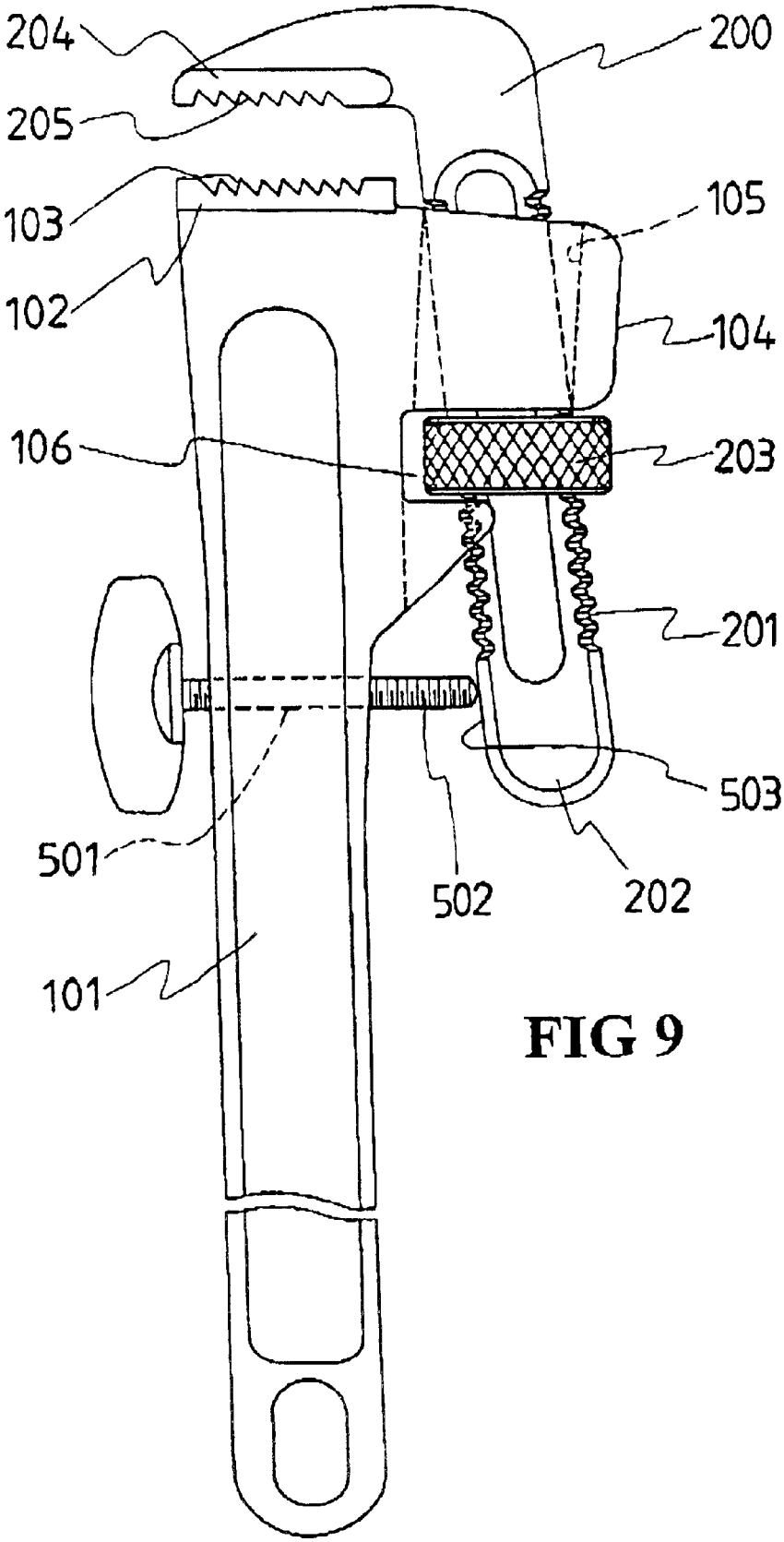
FIG. 9 is a fifth preferred embodiment of the present invention.

FIG. 9 shows a fifth preferred embodiment of the present invention. A threaded rod 502 is provided that can be turned in a lateral screw hole 501 formed in a middle section of the handle 101, to form a pressurizing structure, together with a surface 503 disposed on the inner side of the adjusting lever 202. By turning the threaded rod 201, the adjusting lever 202 can be moved to press the movable jaw 204 toward the fixed jaw 102 of the handle 101 to hold the work object.

As disclosed, the present invention is an improved structure of a pair of pliers allowing easier holding and release motion than the prior art.

I claim:

1. A pair of pipe pliers comprising:

a handle having an output end, a fixed jaw disposed at the output end, and an adjusting channel disposed in a region of the output end;

a threaded nut disposed below the adjusting channel;

a curved movable block having a movable jaw, and a toothed section extending from the adjusting channel and being threadably engaged with said threaded nut, wherein when said threaded nut is turned, said movable jaw is caused to move towards or away from said fixed jaw, said curved movable block being tiltable within the adjusting channel, so that an angle of inclination between said fixed jaw and said movable jaw is variable, said fixed jaw and said movable jaw being adapted to grip a work piece therebetween by pressing in opposite directions when said pair of pipe pliers is turned; and an auxiliary pressurizing mechanism that moves said curved movable block to drive said movable jaw and said fixed jaw relative to each other to increase a pressure against the work piece, and comprising an auxiliary handle, said auxiliary handle having two legs disposed at an angle to each other, being pivotally joined to said handle at a joint disposed in a region where said two legs are connected to each other, and having a slip joint disposed at an end of a shorter one of said two legs, by which said auxiliary handle is slidably joined to said curved movable block, said curved movable block having a channel formed therein for slidably receiving said slip joint, said auxiliary handle further having a return spring that is compressed when an operator squeezes a longer one of said two legs, and which returns said auxiliary handle to its original position when the operator releases said auxiliary handle.

2. A pair of pipe pliers, comprising:

a handle having an output end, a fixed jaw disposed at the output end, and an adjusting channel disposed in a region of the output end;

a threaded nut disposed below the adjusting channel;

a curved movable block having a movable jaw, and a toothed section extending from the adjusting channel and being threadably engaged with said threaded nut, wherein when said threaded nut is turned, said movable jaw is caused to move towards or away from said fixed jaw, said curved movable block being tiltable within the adjusting channel, so that an angle of inclination between said fixed jaw and said movable jaw is variable, said fixed jaw and said movable jaw being adapted to grip a work piece therebetween by pressing in opposite directions when said pair of pipe pliers is turned; and an auxiliary pressurizing mechanism that moves said curved movable block to drive said movable jaw and said fixed jaw relative to each other to increase a pressure against the work piece, and comprising an auxiliary handle, said auxiliary handle having a z-shape defined by a long leg, a short leg joined to said long leg, and a hammerhead structure joined to an end of said short leg, said auxiliary handle being pivotally joined to said handle at a joint disposed in a region where said long leg is joined to said short leg, said hammerhead structure pressing against said toothed section, so that when an operator squeezes the long leg, said hammerhead structure presses said toothed section away from said handle, to move said movable jaw toward said fixed jaw, thereby increasing the pressure against the work piece.

3. A pair of pipe pliers, comprising:

a handle having an output end, a fixed jaw disposed at the output end, and an adjusting channel disposed in a region of the output end;

a threaded nut disposed below the adjusting channel;

a curved movable block having a movable jaw, and a toothed section extending from the adjusting channel and being threadably engaged with said threaded nut, wherein when said threaded nut is turned, said movable jaw is caused to move towards or away from said fixed jaw, said curved movable block being tiltable within the adjusting channel, so that an angle of inclination between said fixed jaw and said movable jaw is variable, said fixed jaw and said movable jaw being adapted to grip a work piece therebetween by pressing in opposite directions when said pair of pipe pliers is turned; and an auxiliary pressurizing mechanism that moves said curved movable block to drive said movable jaw and said fixed jaw relative to each other to increase a pressure against the work piece, and comprising an auxiliary handle, said auxiliary handle having two legs disposed at an angle to each other, being pivotally joined to said handle at a slip joint disposed in a region where said two legs are connected to each other, and having a joint disposed at an end of a shorter one of said two legs, by which said auxiliary handle is joined to an end of said toothed section, said handle having a channel formed therein for slidably receiving said slip joint, wherein when an operator squeezes a longer one of said two legs, said slip joint slides in the channel, said toothed section is moved away from said handle, and said movable jaw is moved toward said fixed jaw, thereby increasing the pressure against the work piece.

4. A pair of pipe pliers, comprising:

a handle having an output end, a fixed jaw disposed at the output end, and an adjusting channel disposed in a region of the output end;

a threaded nut disposed below the adjusting channel;

a curved movable block having a movable law, and a toothed section extending from the adjusting channel and being thread ably engaged with said threaded nut, wherein when said threaded nut is turned, said movable jaw is caused to move towards or away from said fixed jaw, said curved movable block being tiltable within the adjusting channel, so that an angle of inclination between said fixed jaw and said movable jaw is variable, said fixed jaw and said movable jaw being adapted to grip a work piece therebetween by pressing in opposite directions when said pair of pipe pliers is turned; and an auxiliary pressurizing mechanism that moves said curved movable block to drive said movable jaw and said fixed jaw relative to each other to increase a pressure against the work piece, and comprising a lateral adjusting screw structure, said lateral adjusting screw structure including a threaded screw through hole formed in said toothed section, and a threaded rod threadably engaged with the threaded screw through hole, wherein when said threaded rod is screwed into the threaded screw through hole, an end of said threaded rod engages with said handle, causing said toothed section to move away from said handle, and said movable jaw to move toward said fixed jaw, thereby increasing the pressure against the work piece.

5. A pair of pipe pliers, comprising:

a handle having an output end, a fixed jaw disposed at the output end, and an adjusting channel disposed in a region of the output end;

a threaded nut disposed below the adjusting channel;

a curved movable block having a movable jaw, and a toothed section extending from the adjusting channel and being threadably engaged with said threaded nut, wherein when said threaded nut is turned, said movable jaw is caused to move towards or away from said fixed jaw, said curved movable block being tiltable within the adjusting channel, so that an angle of inclination between said fixed jaw and said movable jaw is variable, said fixed jaw and said movable jaw being adapted to grip a work piece therebetween by pressing in opposite directions when said pair of pipe pliers is turned; and an auxiliary pressurizing mechanism that moves said curved movable block to drive said movable law and said fixed jaw relative to each other to increase a pressure against the work piece, and comprising a lateral adjusting screw structure, said lateral adjusting screw structure including a threaded screw through hole formed in said handle, and a threaded rod threadably engaged with the threaded screw through hole, wherein when said threaded rod is screwed into the threaded screw through hole, an end of said threaded rod engages with said toothed section, causing said toothed section to move away from said handle, and said movable jaw to move toward said fixed jaw, thereby increasing the pressure against the work piece.

* * * * *